United States Patent [19]

Gawlik et al.

[11] Patent Number: 4,643,511

[45] Date of Patent: Feb. 17, 1987

[54] AUXILIARY WIRE CONNECTIONS FOR SIDE POST BATTERIES

[75] Inventors: Robert F. Gawlik; Timothy C. Eccles, both of Olathe, Kans.

[73] Assignee: System Material Handling Company, Olathe, Kans.

[21] Appl. No.: 810,723

[22] Filed: Dec. 19, 1985

[51] Int. Cl.[4] ..... H01R 11/26

[52] U.S. Cl. ..... 339/231; 339/224

[58] Field of Search ..... 339/224, 225, 231, 232, 339/263 B

[56] References Cited

U.S. PATENT DOCUMENTS

| | | | |
|---|---|---|---|
| 3,407,383 | 10/1968 | Haegert | 339/230 |
| 3,605,065 | 9/1971 | Shannon | 339/224 |
| 3,928,079 | 12/1975 | Jennings et al. | 339/224 |
| 4,288,504 | 9/1981 | Julian et al. | 339/232 |
| 4,483,910 | 11/1984 | Julian | 339/232 |

*Primary Examiner*—Gil Weidenfeld

*Assistant Examiner*—Paula A. Austin

*Attorney, Agent, or Firm*—Schmidt, Johnson, Hovey & Williams

[57] ABSTRACT

A mount for attachment of a pair of cables to a side terminal of a battery has a stud releasably connected to the terminal for receiving the perforated lug of one of the cables with the stud having a fastener for releasably attaching thereto the perforated lug of the other cable.

8 Claims, 5 Drawing Figures

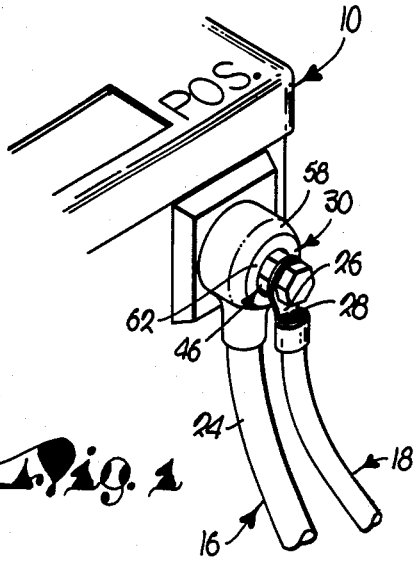
Fig. 1
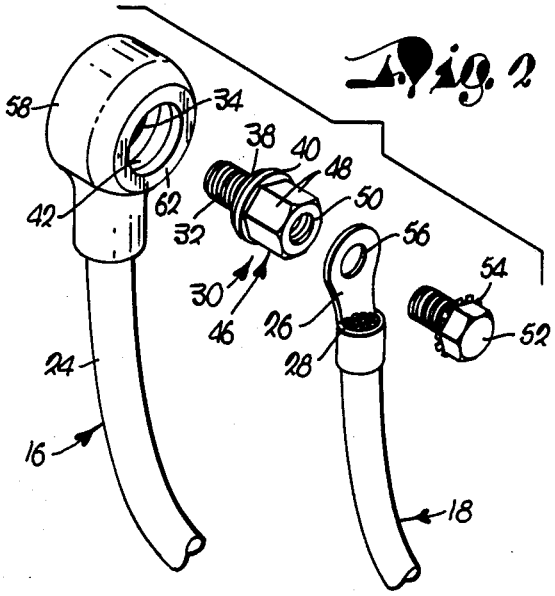
Fig. 2
Fig. 3
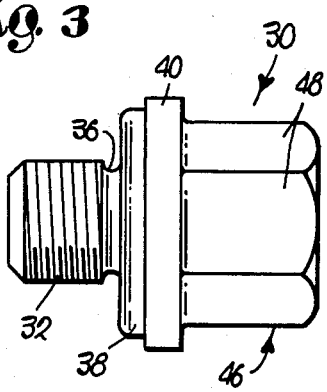
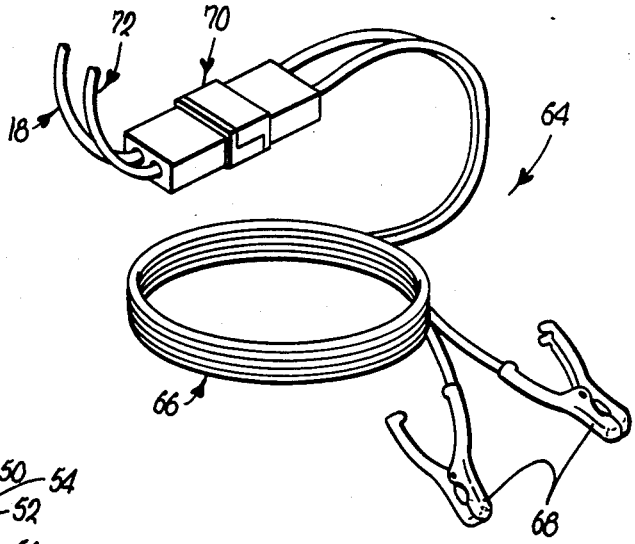
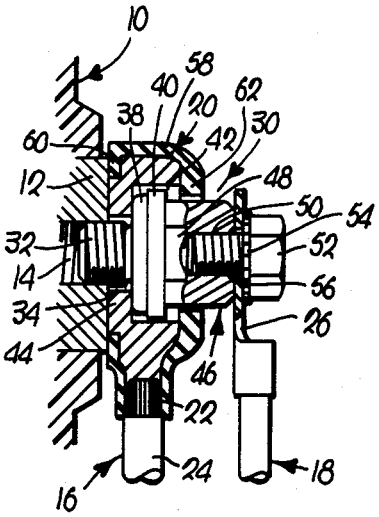
Fig. 4
Fig. 5

AUXILIARY WIRE CONNECTIONS FOR SIDE POST BATTERIES

The present invention relates to cable connections for side terminal batteries including primary power and auxiliary cables and their associated grounding cables through use of side post studs releasably attached to the terminals.

As distinguished from upstanding posts for receiving clamps to connect cables to batteries, in current use also are batteries which have side terminals for such purpose. Various types of fasteners, usually bolts, are employed to connect the cables to the terminals. It is also not uncommon to provide auxiliary cables for add-on electrical equipment requiring modification of the mounts which couple the primary cables with the side terminals of the battery.

There have been many suggestions for such modifications, including lengthened battery terminal bolts, special adapters, spacers, insulating boots, terminal covers, wing nuts and other miscellaneous parts. But none have proved to be fully successful.

The problems lie not only in high manufacturing costs but, more particularly in ease of attachment and detachment without risk in the process of damaging or misplacement of a multiplicity of relatively small component parts. Moreover, in such modifications, corrosion problems, short circuiting problems and problems of loosening have not heretofore been satisfactorily met. In accordance with the instant invention, therefore, there is provided, for each side termi-nal respectively, a single composite, fully assembled mount which employs a strong, one piece, solid, metallic, inexpensive side post stud, having not only a means for releasable connection of the stud to the battery terminal but a means for releasable attachment thereto of an auxiliary cable. Among the many attributes is the novel way the terminal lug of the primary cable is clamped against the side terminal of the battery; the advantageous way an insulating sheath on the stud is used to preclude accidental disassembly; and the extremely simple and handy way the lug of the auxiliary cable is releasably connected to the stud.

In the drawings:

FIG. 1 is a fragmentary perspective view of a battery showing one of the mounts of the present invention which includes an auxiliary wire connection to a side terminal of the battery;

FIG. 2 is a fragmentary, exploded, perspective view of certain components of the mount in relationship to a pair of battery cables;

FIG. 3 is an enlarged side elevational view of the side post stud forming a part of the mount;

FIG. 4 is a fragmentary view of the battery and cables showing the mount in section medially therethrough; and FIG. 5 is a perspective view of an assembly depective one suggested use of the auxiliary wire connection.

In FIGS. 1 and 4 of the drawings there is fragmentarily illustrated a conventional battery 10 (as for use in automotive vehicles) for generating voltaic electricity and provided with the usual, internal cells (not shown) containing electrodes and an electrolyte as is well known. The battery 10 is of the type which has a pair of metallic side terminals protruding beyond its case, one only being shown and designated by the numeral 12. As is common, the terminal 12 has an outwardly facing hole 14 provided with internal screw threads.

Shown also in FIGS. 1, 2 and 4 is a pair of cables 16 and 18 for operable connection to the terminal 12 through use of the mount of our instant invention, utilizing the hole 14. The insulated cable 16 is provided with a metallic, perforated, terminal lug 20 molded around conducting strands 22 after removal of a portion of insulating sheath 24 of the cable 16. The cable 18 is also provided with a metallic, perforated, terminal lug 26 conventionally attached to its conducting strands 28.

The aforementioned mount includes a side post stud 30 in the nature of a one-piece, solid, metallic body having an element at one end thereof in the nature of a boss 32 extending through a perforation 34 in the lug 20 and into the hole 14 as seen in FIG. 4. The boss 32 has external screw threads which mesh with the threads within the hole 14.

The stud 30 is also provided with a member (separated from the boss 32 by an annular groove 36 in the stud 30) in the nature of a first continuous, outwardly extending flange 38 for clamping the lug 20 against the terminal 12 when the threads of the boss 32 are in mesh with the threads in the hole 14.

The stud 30 has a second, continuous, outwardly extending flange 40 adjacent the flange 38 but of a slightly greater diameter than the diameter of the flange 38, it being noted that the flange 38 is disposed between the flange 40 and the groove 36 and that the lug 20 has a cavity 42 enclosing the flanges 38 and 40 and communicating with the perforation 34. Moreover, the lug 20 has a continuous, inturned lip 44 surrounding the perforation 34 and clamped between the terminal 12 and the flange 38.

Additionally, the stud 30 has a polygonal head 46 at that (outer) end thereof opposite to the inner, free end of the boss 32 provided with wrench-engaging flats 48 used to rotate the stud 30 when the boss 32 is to be attached to the terminal 12. The outer end of the head 46 has a socket 50 extending thereinto toward the flange 40 and provided with internal screw threads. A fastener 52 (such as a bolt) having a lockwasher 54 passes through perforation 56 of the lug 26 and into threaded engagement with the head 46 within the socket 50.

Structure for preventing displacement of the stud 30 from the lug 20 includes an insulating, protective sheath 58 which covers the lug 20. The sheath 58 has an inner lip 60 clamped between the lug 20 and the terminal 12 and an outer lip 62 surrounding the head 46. The lip 62 readily yields to pressure of the flange 40 when the stud 30 is inserted into the shield 58 as the flange 40 is moved into the cavity 42; yet, the lip 62 maintains full assembly of the lug 20, the stud 46 and the sheath 58 upon removal of the boss 32 from the terminal 12.

The power cables 16 and 18 are shown and above described only in association with the positive pole of the battery 10. The same instrumentalities are contemplated for association with the negative pole of the battery 10 including a grounding cable attached to a second side terminal of the battery and an auxiliary grounding cable releasably connected to a second side post stud.

When the mounts are used with a vehicle battery, the cable 16 and its associated ground cable are employed in the usual manner whereas the cable 18 and its associated grounding cable are used for any desired add/on electrical equipment such as mobile radios, alarm systems, etc. Our corrosion resistant mount permits all connections to be made directly at the battery 12 to lessen the possibility of short circuits and resulting vehicle damage.

The auxiliary cables are especially advantageous for use with a jumper cable assembly 64 having a connector harness 66 provided with battery clamps 68. Conventional couplings 70 may be employed between the harness 66 and the two auxiliary cables 18 and 72.

We claim:

1. A mount for connecting perforated terminal lugs of a pair of cables directly to a battery side terminal having a hole provided with internal screw threads, said mount comprising:

a stud adapted to extend through the perforation of the lug of one of said cables, said stud including:

an element at one end of the stud having external screw threads disposed to mesh with said internal threads, a member intermediate the ends of the stud for clamping said lug of the one cable against said side terminal when the external threads are in mesh with the internal threads, a device at the opposite end of the stud for releasably attaching the lug of the other cable to the stud, and structure for preventing displacement of the stud from the lug of said one cable, said stud having a socket at said opposite end thereof provided with internal screw threads, said device being a fastener adapted to extend through the perforation of the lug of the other cable and having external screw threads disposed to mesh with the threads of the socket.

2. The invention of claim 1, said structure including a sheath covering said lug of the one cable, there being a lip on the sheath surrounding the stud and said stud having an external flange surrounded by the sheath, disposed between the member and the lip and retained by the lip, said stud having a head provided with wrench-engaging flats for rotating the stud to intermesh said threads, said socket extending into the head.

3. The invention of claim 2, said member being a second external flange on the stud disposed to engage the lug of the one cable.

4. The invention of claim 3, said element being a boss integral with the second flange.

5. The invention of claim 4, said lug of the one cable having a cavity housing the flanges.

6. The invention of claim 5, there being a second lip on the lug of said one cable surrounding the perforation of the lug of the one cable and clamped against the side terminal.

7. The invention of claim 6 wherein the stud has a socket at said opposite end thereof provided with internal screw threads, said device being a fastener adapted to extend through the perforation of the lug of the other cable and having external screw threads disposed to mesh with the threads of the socket.

8. The invention of claim 7, said boss, said flanges and said head being a one piece, solid, metallic body.

* * * * *